US006926043B2

(12) United States Patent
Quigley et al.

(10) Patent No.: US 6,926,043 B2
(45) Date of Patent: Aug. 9, 2005

(54) FORMING FABRICS

(75) Inventors: Scott David Quigley, Bossier City, LA (US); James Michael Kramer, Shreveport, LA (US); James Loy Brewster, Waskom, TX (US)

(73) Assignee: Voith Fabrics GmbH & Co. KG, Pfulligen (DE)

( * ) Notice: Subject to any disclaimer, the term of this patent is extended or adjusted under 35 U.S.C. 154(b) by 264 days.

(21) Appl. No.: 10/449,051

(22) Filed: May 30, 2003

(65) Prior Publication Data

US 2004/0238062 A1 Dec. 2, 2004

(51) Int. Cl.[7] ..... D21F 3/00

(52) U.S. Cl. ..... 139/383 A; 162/358.2; 162/900; 442/203; 442/207

(58) Field of Search ..... 139/383 A; 162/900, 162/902, 903, 358.2; 442/203, 206, 207

(56) References Cited

U.S. PATENT DOCUMENTS

| | | | | | |
|---|---|---|---|---|---|
| 4,989,648 | A | * | 2/1991 | Tate et al. | 139/383 A |
| 5,074,339 | A | * | 12/1991 | Vohringer | 139/383 A |
| 5,343,896 | A | * | 9/1994 | Schroder et al. | 139/383 A |
| 5,826,627 | A | | 10/1998 | Seabrook et al. | |
| 6,240,973 | B1 | * | 6/2001 | Stone et al. | 139/383 A |

OTHER PUBLICATIONS

Intl. Appl. No. PCT/EP2004/050712; Intl. Filing Date:May 5, 2004; Appl. Voith Fabrics Patent GMBH.

* cited by examiner

*Primary Examiner*—John J. Calvert
*Assistant Examiner*—Robert H Muromoto, Jr.
(74) *Attorney, Agent, or Firm*—Notaro & Michalos PC

(57) ABSTRACT

A forming fabric has a paperside warp layer and a machine side warp layer. The fabric comprises at least one set of machine side wefts and at least one set of weft triplets, the weft triplets together forming two continuous weft paths on the paperside. All of the weft triplets interweave with at least some paperside warps and at least some machine side warps.

8 Claims, 18 Drawing Sheets

FORMING FABRICS

The present invention relates to forming fabrics for use in the forming section of a papermaking machine.

Paper is conventionally manufactured by conveying a paper furnish, usually consisting of an initial slurry of cellulosic fibres, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder and then creped.

Papermachine clothing is essentially employed to carry the paper web through these various stages of the papermaking machine. In the forming section the fibrous finish is wet-laid onto a moving forming wire and water is encouraged to drain from it by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. In the final stage, the paper web is transferred either to a Yankee dryer, in the case of tissue paper manufacture, or to a set of dryer cylinders upon which, aided by the clamping action of the dryer fabric, the majority of the remaining water is evaporated.

So called "triple layer" papermachine fabrics are known in the art. These generally comprise paper side and machine side warp and weft yarn systems, which are bound together by binder yarns.

U.S. Pat. No. 6,354,335 B1 discloses a triple layer fabric in which the paperside yarn system contains so called "substitute" wefts which replenish the yarn paths of two adjacent binder wefts at the points where they engage the machine side warps. These replenishing yarns weave with the paperside warps only and not with the machine side warps. Consequently the fabric provides insufficient binding between the paperside and machine side of the fabric.

U.S. Pat. No. 6,240,973 B1 describes a forming fabric comprising a single warp system and two weft systems, i.e. a paperside weft system and a machine side weft system. As the fabric has only a single warp system it is not a true triple layer fabric in that it does not comprise two independent warp systems.

The single warp system comprises sets of warp yarn triplets. All of the warp yarn triplets bind with paperside wefts and machine side wefts. The warp yarn triplets together form a single warp path. Consequently the fabric comprises a significant amount of warp yarn and is thus expensive to make. Furthermore, this limits the number of warp paths that may feasibly be included in the fabric.

This fabric is not as thick as typical triple layer fabrics, which have two independent fabric layers, and consequently is less stable.

The present invention has been made from a consideration of these problems.

According to the present invention there is provided a forming fabric having a paperside warp layer and a machine side warp layer, the fabric comprising at least one set of machine side wefts and at least one set of weft triplets, the weft triplets together forming two continuous weft paths on the paperside, all of said weft triplets interweaving with at least some paperside warps and at least some machine side warps.

A weft triplet is herein defined as a weft yarn belonging to a group of three weft yarns all of which bind to at least one warp yarn in the wearside fabric layer and is either an external or central member of the group of three weft yarns wherein one external triplet member and the internal triplet member form one continuous paperside weft path and the internal triplet member and the remaining external triplet member form a second continuous weft path in the fabric paperside which lies adjacent the first continuous weft path of the triplets.

These triple layer fabrics of the invention are stable, providing sufficient binding between the two warp layers. Furthermore as three weft triplets form two paths through the fabric, the fabric is considerably less complex and less expensive to manufacture than the system disclosed in U.S. Pat. No. 6,240,973B1.

Preferably the fabric of the present invention has a 20 warp repeat or greater. Preferred examples of warp repeat sizes could also be 24 shaft, or greater. The machine side wefts may, for example, make a single binding with the machine side warps over a five warp repeat. However, other wearside weave patterns can be used e.g. 6 shaft repeat with single interlacing or an eight or ten shaft with multiple non-adjacent warp-weft interlacings.

In some embodiments of the invention the fabric preferably further comprises a further set of wefts which bind only with the paperside warps, ideally in a plain weave.

In order that the present invention may be more readily understood, specific embodiments thereof will now be described by way of illustration only with reference to the accompanying drawings in which.

Figure 1:
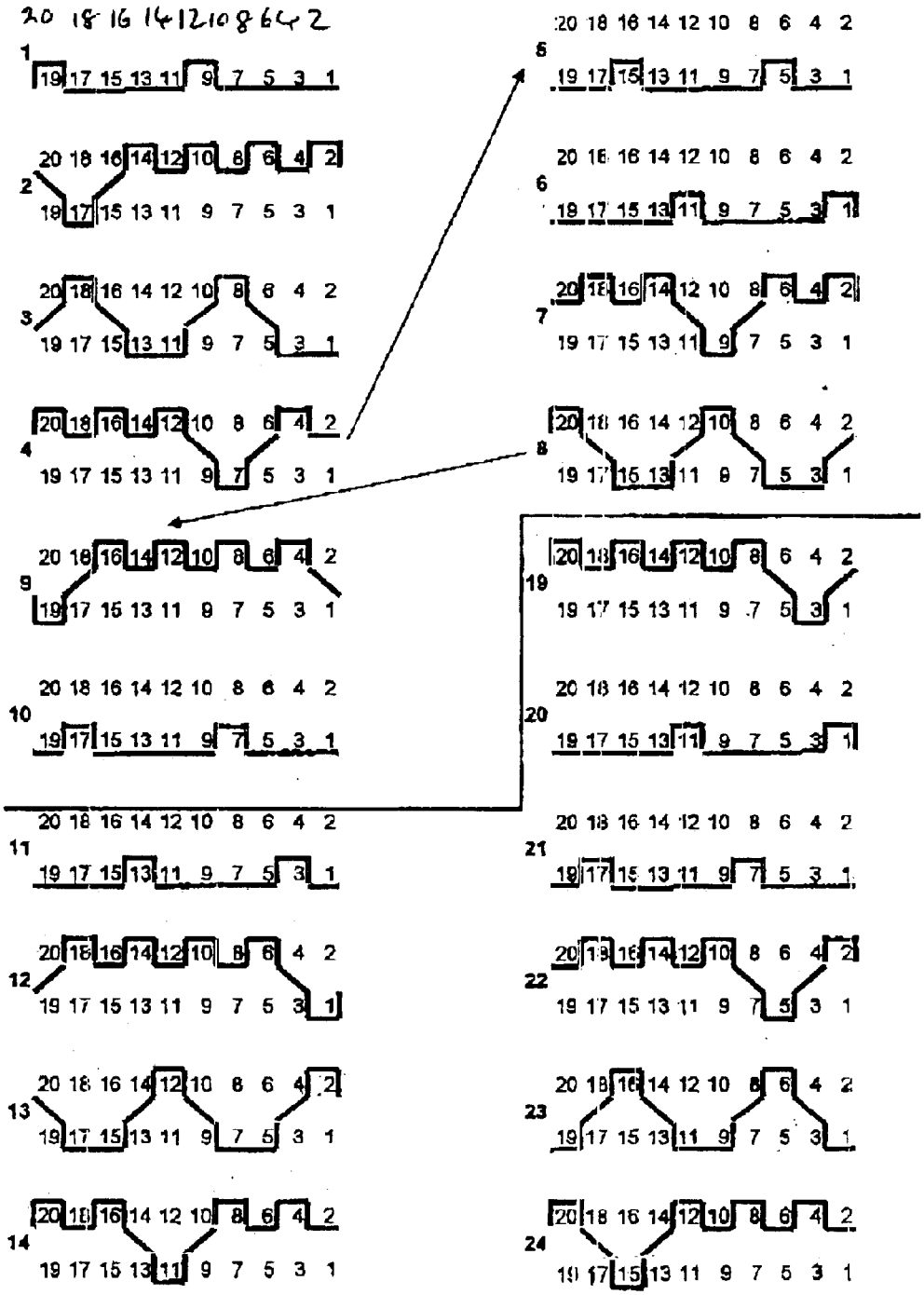
FIG. 1 is a series of warp cross-sectional diagrams showing the consecutive weft paths of a fabric in accordance with the present invention.
Figure 1:
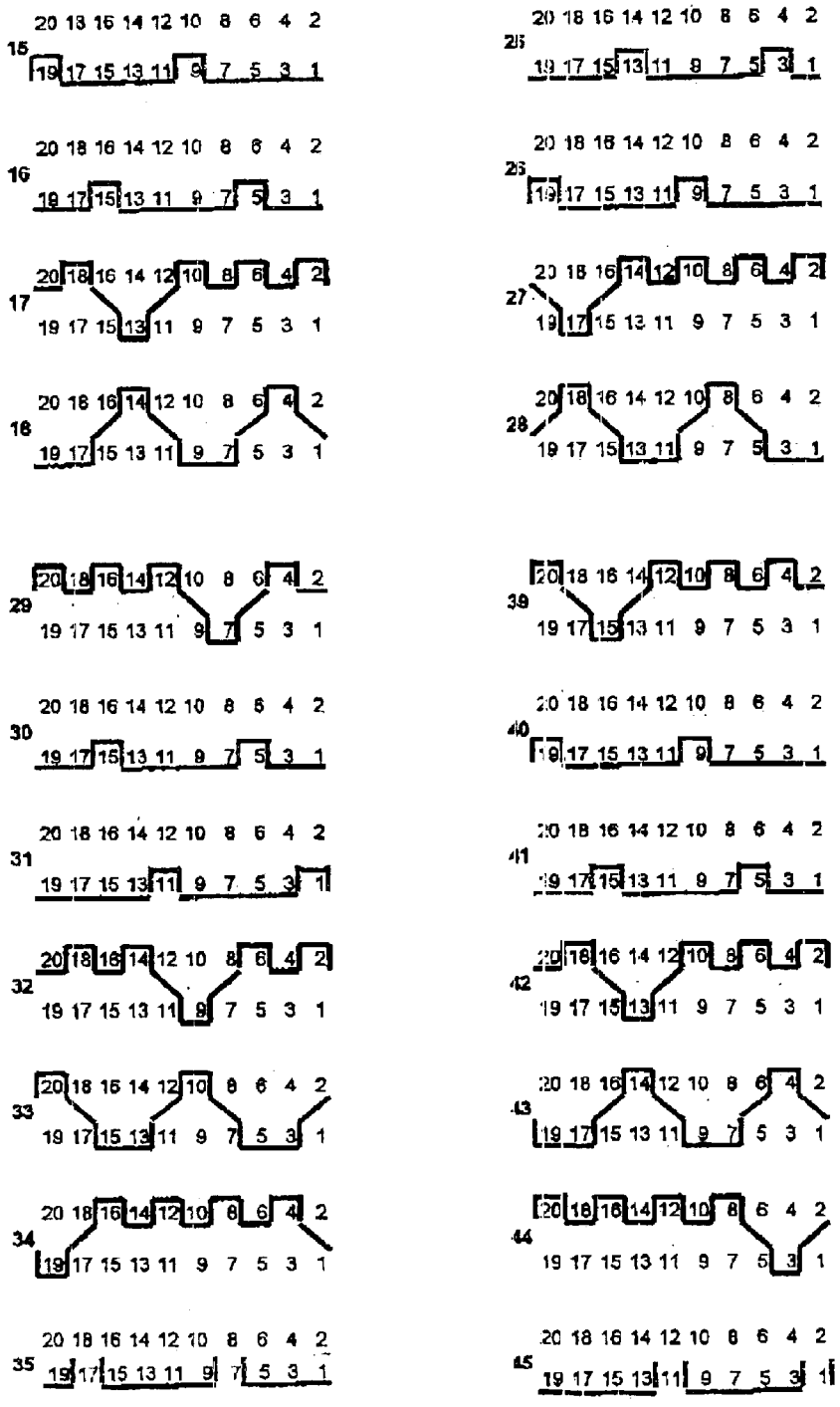
Figure 1:
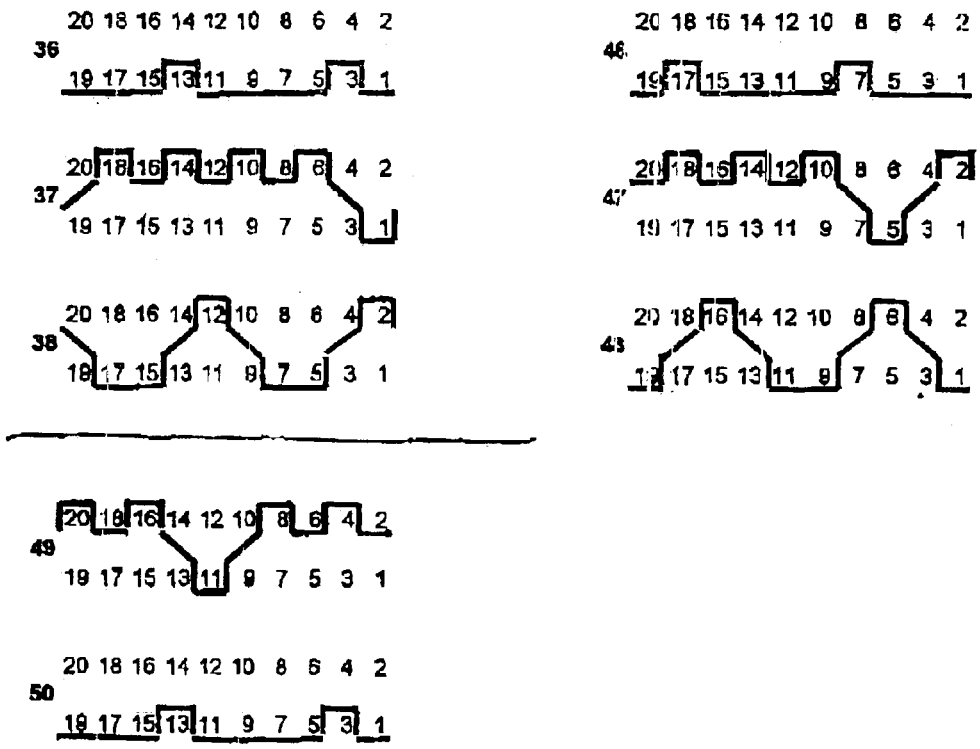

Referring to FIG. 1 a fabric in accordance with the invention has a twenty warp yarn repeat and a fifty weft repeat.

Each of the diagrams shown in FIG. 1 shows the twenty yarn warp repeat. There is a 1:1 effective paperside to wearside warp ratio, comprising machine side warps (1, 3, 5, 7, 9, 11, 13, 15, 17, 19) and paperside warps (2, 4, 6, 8, 10, 12, 14, 16, 18, 20).

The weft yarns fall into two categories. The first set of weft yarns, as exemplified by wefts 1, 5, 6, and 10, bind only with the machine side warps, the weave repeat being over five machine side or wearside yarns, binding with every fifth wearside yarn. Thus the fabric has a so-called five shaft back.

The remaining wefts form triplet groups binding with both the paperside and machine side warp yarns. In this example, there are no weft yarns binding only with paperside warps. The weft triplets together form two complete weft paths on the paperside surface. This can be seen from the triplet comprising wefts 2, 3 and 4 in which the middle weft triplet binds with warp 18 completing an effective plain weave pattern for the outer weft triplet 2. Similarly, the central weft 3 forms a knuckle over paperside warp 8 and completes an effective plain weave pattern for outer weft triplet 4. Each triplet repeats over twenty warps. Furthermore, in this example, the individual wefts of each set of triplets make four, two and four paperside bindings respectively and one, two and one wearside bindings respectively. This can be seen for example, with wefts 2, 3 and 4 which, as stated previously, together form a weft triplet group. Weft 2 forms a wearside binding around wearside warp 17 and then paperside bindings over warps 14, 10, 6 and 2. Similarly weft 3 forms a binding over paperside warp 18 and then binds around wearside warps 13, 11 before binding over paperside warp 8 and then around wearside warps 3, 1. The third yarn of the triplet group forms a binding around wearside warp 19 before binding in a plain weave pattern over paperside warps 16, 12, 8 and 4.

It is noted that the fabric has a 1:1 effective paperside to wearside weft ratio. It is further noted that no "reversing" of the triplet groups is possible in that the outer triplets of each triplet group have the same frequency of inlerlacings. Reversing is a technique used in the weaving of fabrics to break up twill patterns. Such patterns manifest themselves in the paper formed in the fabric and are considered to be undesirable.

Figure 2:
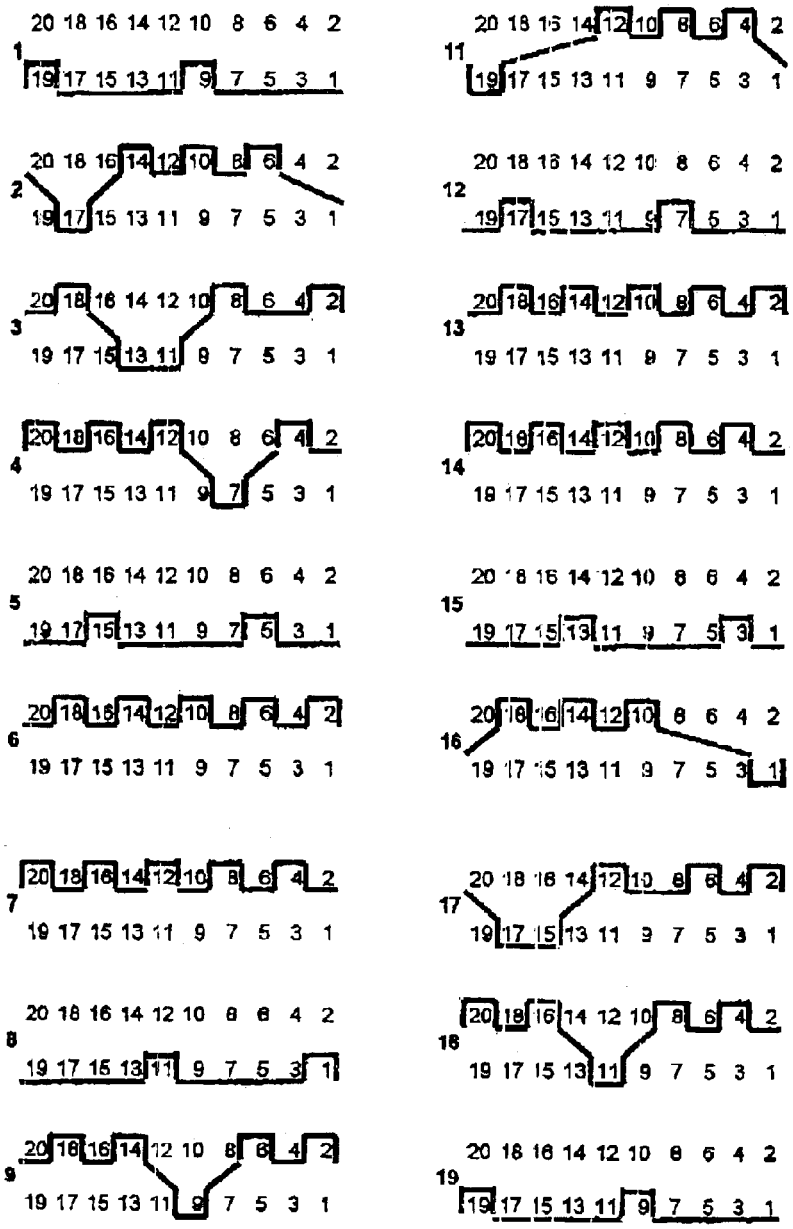
FIG. 2 is a series of warp cross sectional diagrams showing consecutive weft paths of a second fabric in accordance with the present invention.
Figure 2:
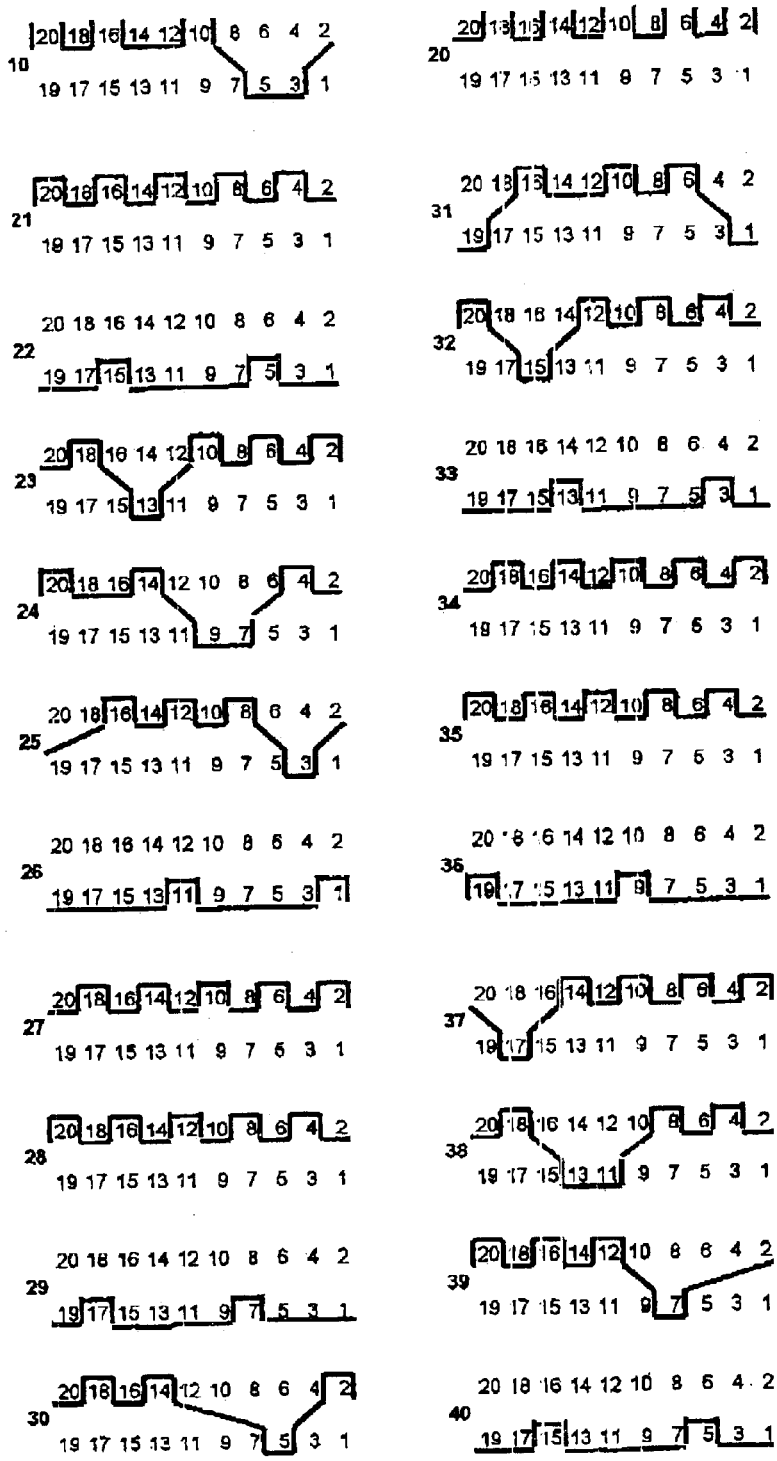
Figure 2:
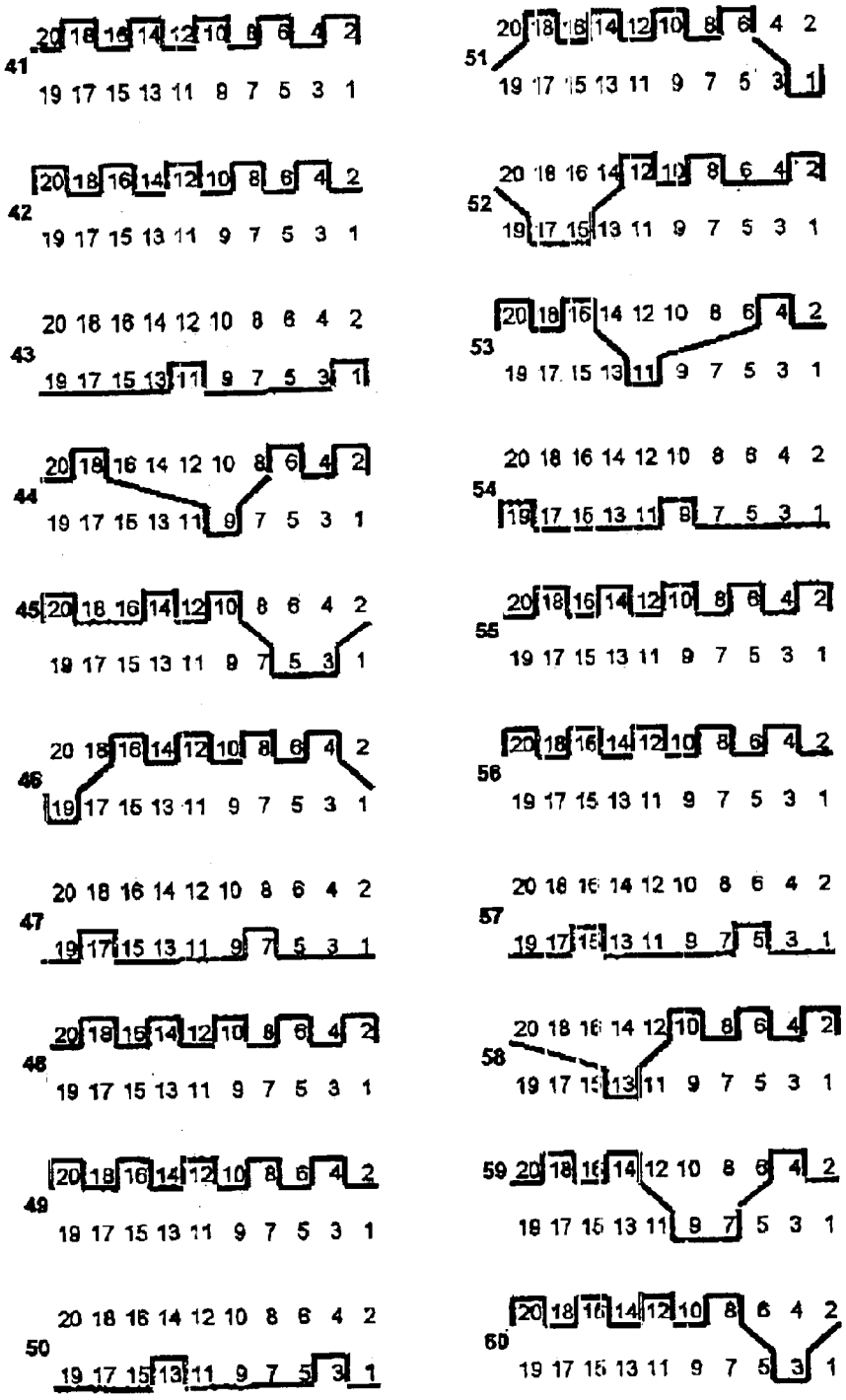
Figure 2:
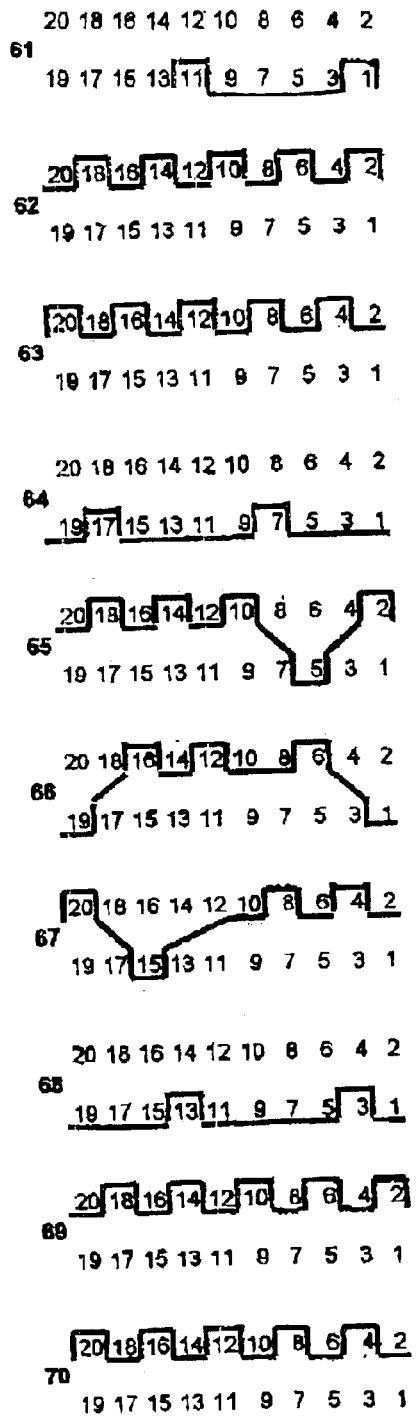

Referring to FIG. 2 a second triple layer fabric in accordance with the invention has a twenty warp yarn repeat and a seventy weft repeat.

Each of the diagrams shown in FIG. 2 shows the twenty yarn warp repeat. There is a 1:1 effective paperside to wearside warp ratio, comprising machine side warps (1, 3, 5, 7, 9, 11, 13, 15, 17, 19) and paperside warps (2, 4, 6, 8, 10, 12, 14, 16, 18, 20).

The weft yarns fall into three categories. The first set of weft yarns, as exemplified by wefts 1, 5, 8 and 12 bind only with the machine side warps, the weave repeat being over five machine side or wearside yarns, forming a knuckle over every fifth wearside yarn. Thus the fabric has a so-called five shaft back.

The second set of wefts, as exemplified by wefts 6, 7, 13 and 14, bind only with the paperside warps in a plain weave. These paperside wefts contribute to the fabric having a 2:1 effective paperside to wearside weft ratio.

The third set of wefts form triplet groups binding with both the paperside and machine side warps. Each triplets group forms two complete weft paths on the paperside surface, each triplet repeating over twenty warps.

Furthermore, in this example, the individual triplets of each triplet group make three, three and four bindings respectively. Due to the fact that the frequency of interlacings of the outer triplets is different in this case, the order can therefore be reversed so as to remove visually apparent twill lines, which manifest themselves in the paper formed in the fabric. As stated previously this reversing technique is known in the art for other fabrics. Thus, triplets 2, 3, 4 have three, three and four paperside bindings respectively. This sequence is reversed for the next triplet 9, 10, 11 living four, three and three paperside bindings.

All middle wefts of each triplet group make two wearside bindings compared to the two outer triplet wefts which make one wearside binding. This can be seen from the triplet group comprising wefts 2, 3 and 4. Here the first outer weft triplet 2 makes a binding around wearside warp 17 before binding over paperside warps 14, 10, 16 in a plain weave. The central weft triplet 3 binds over paperside warp 18 before binding around adjacent wearside warps 13, 11 and then over paperside warps 8 and 2. The second outer weft triplet binds over warps 20, 16 and 12 in a plain weave before binding around warp 7 and then over paperside warp 4.

The ratio of the top paperside wefts to the triplet groups is 2:1.

Figure 3:
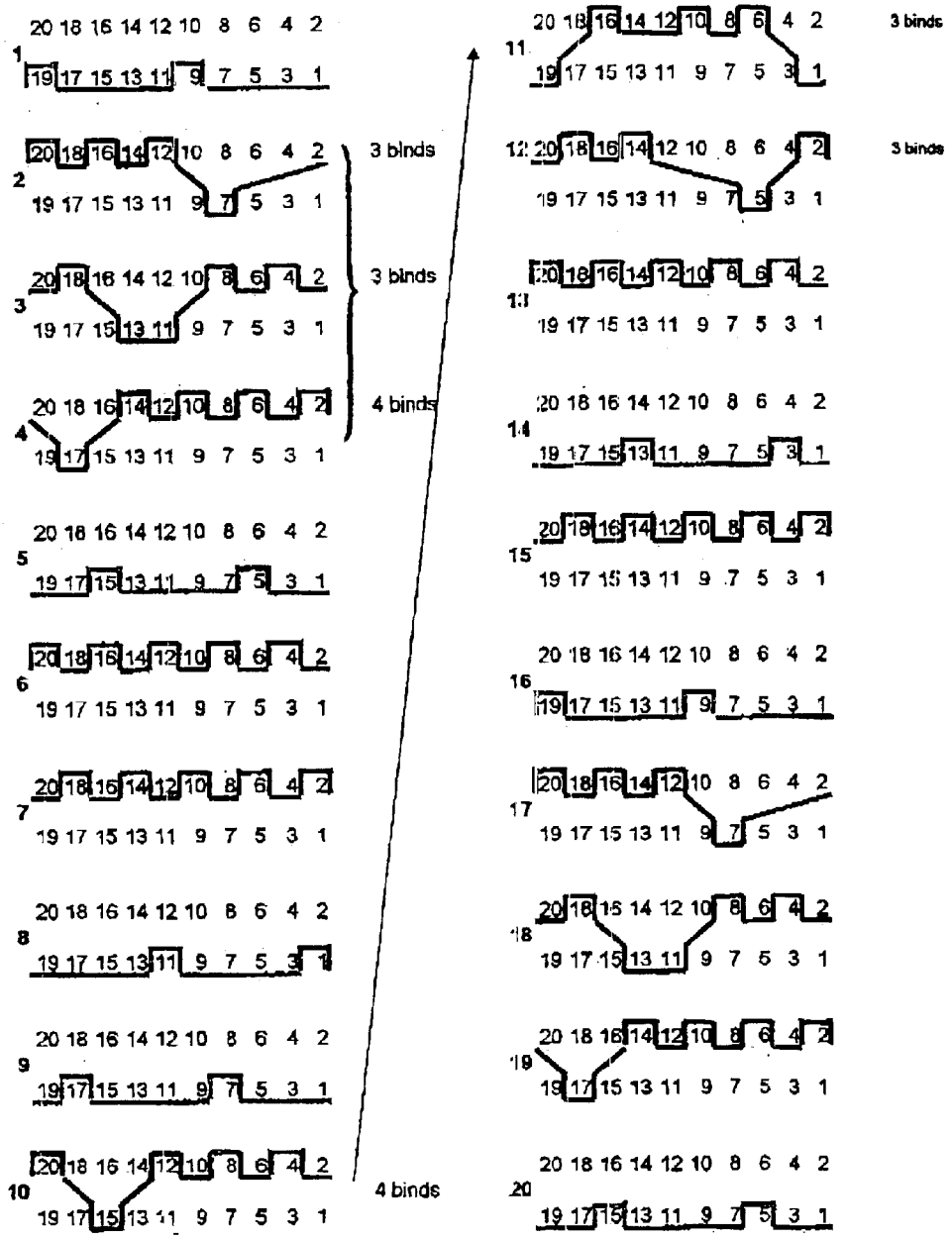
FIG. 3 is a series of warp cross sectional diagrams showing consecutive weft paths of a third fabric in accordance with the present invention.
Figure 3:
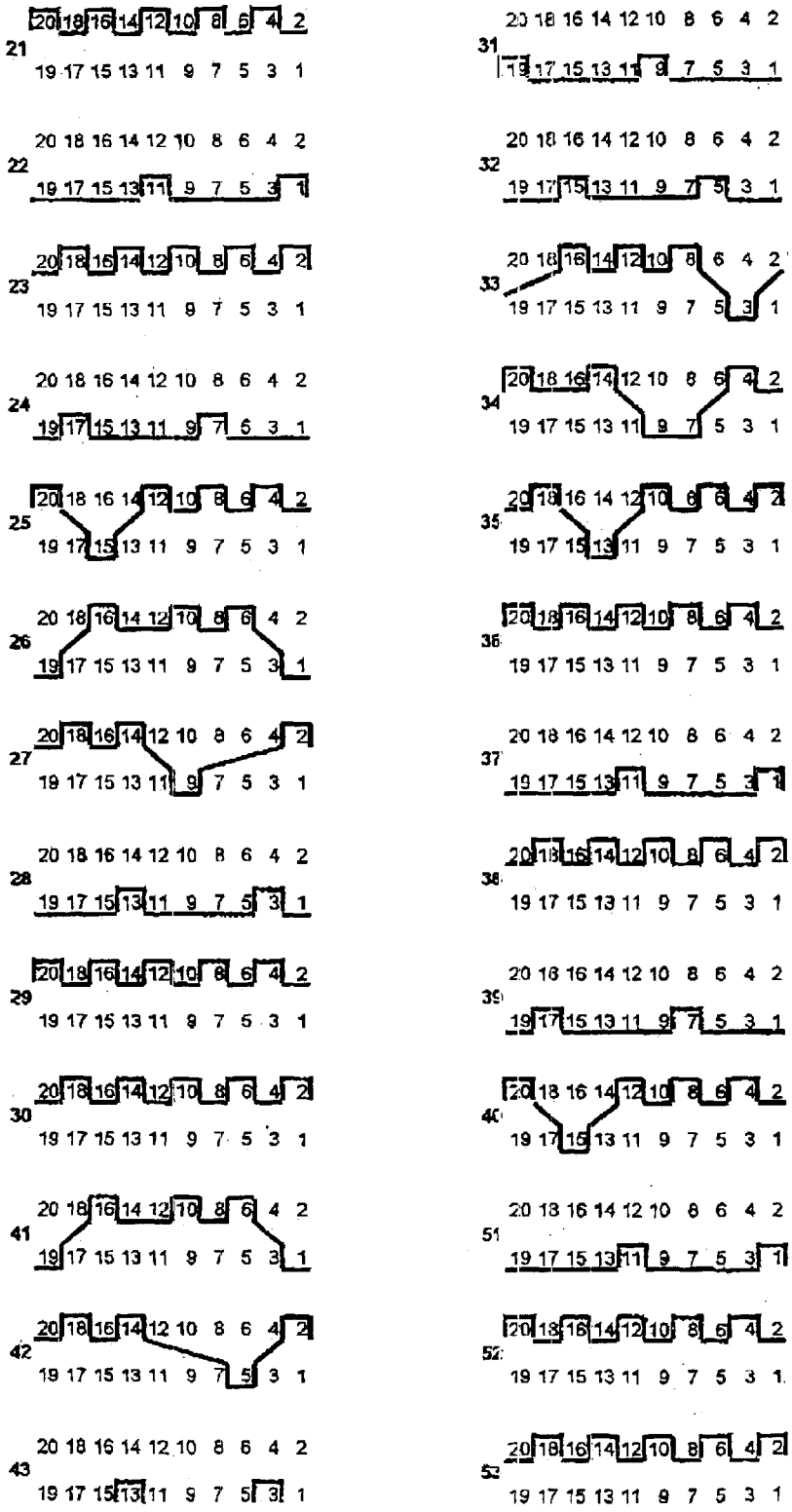
Figure 3:
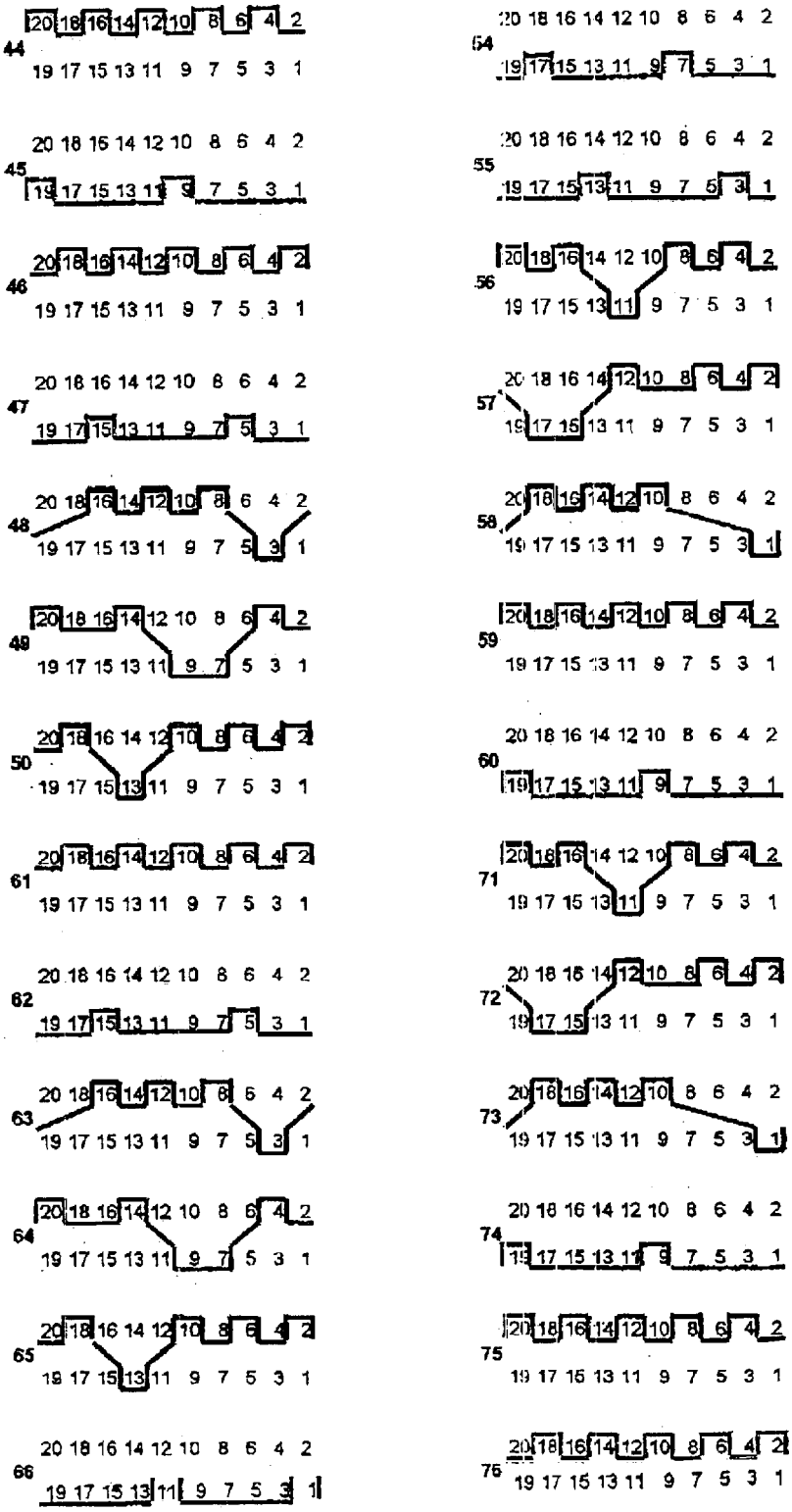
Figure 3:
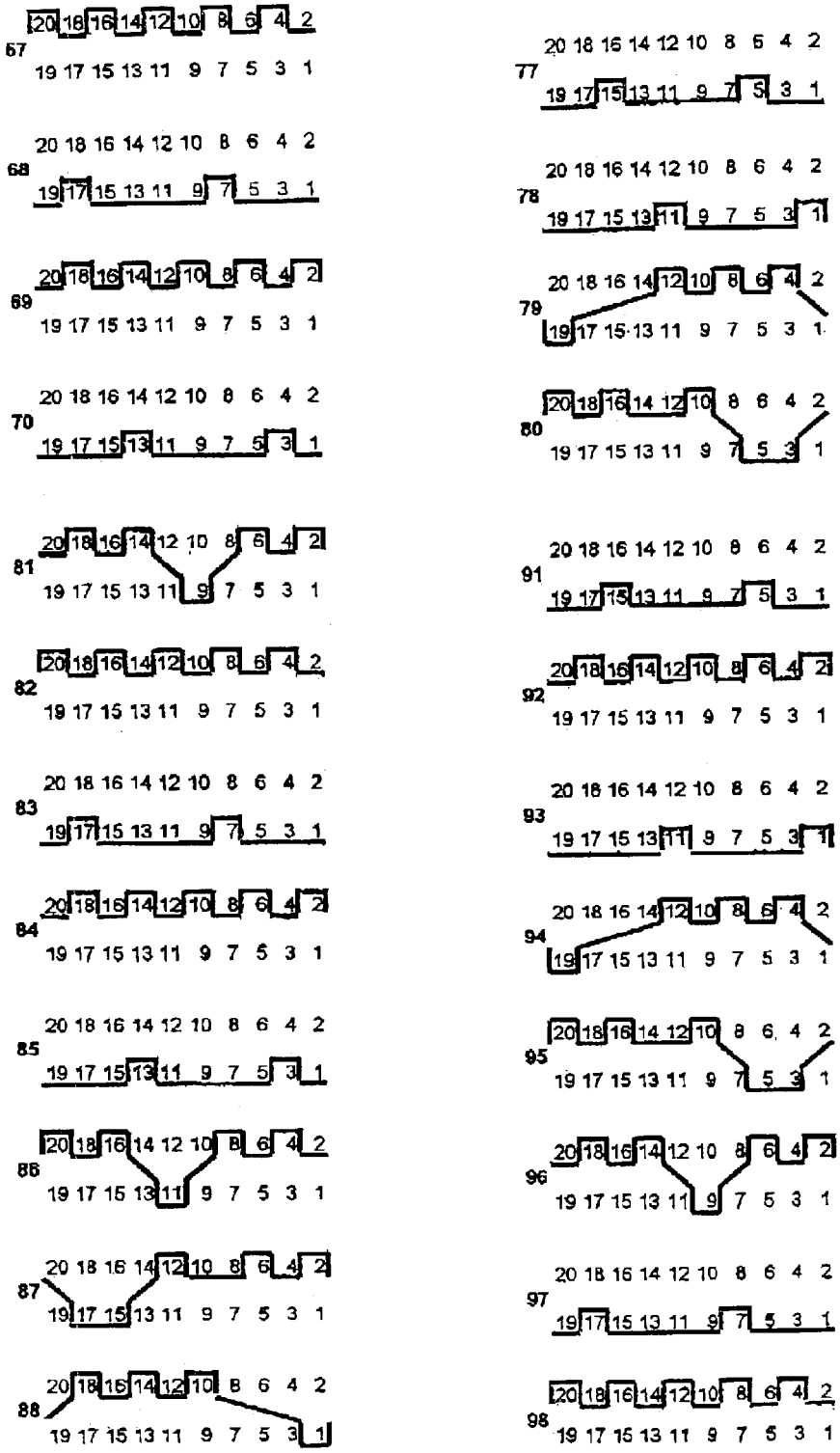
Figure 3:
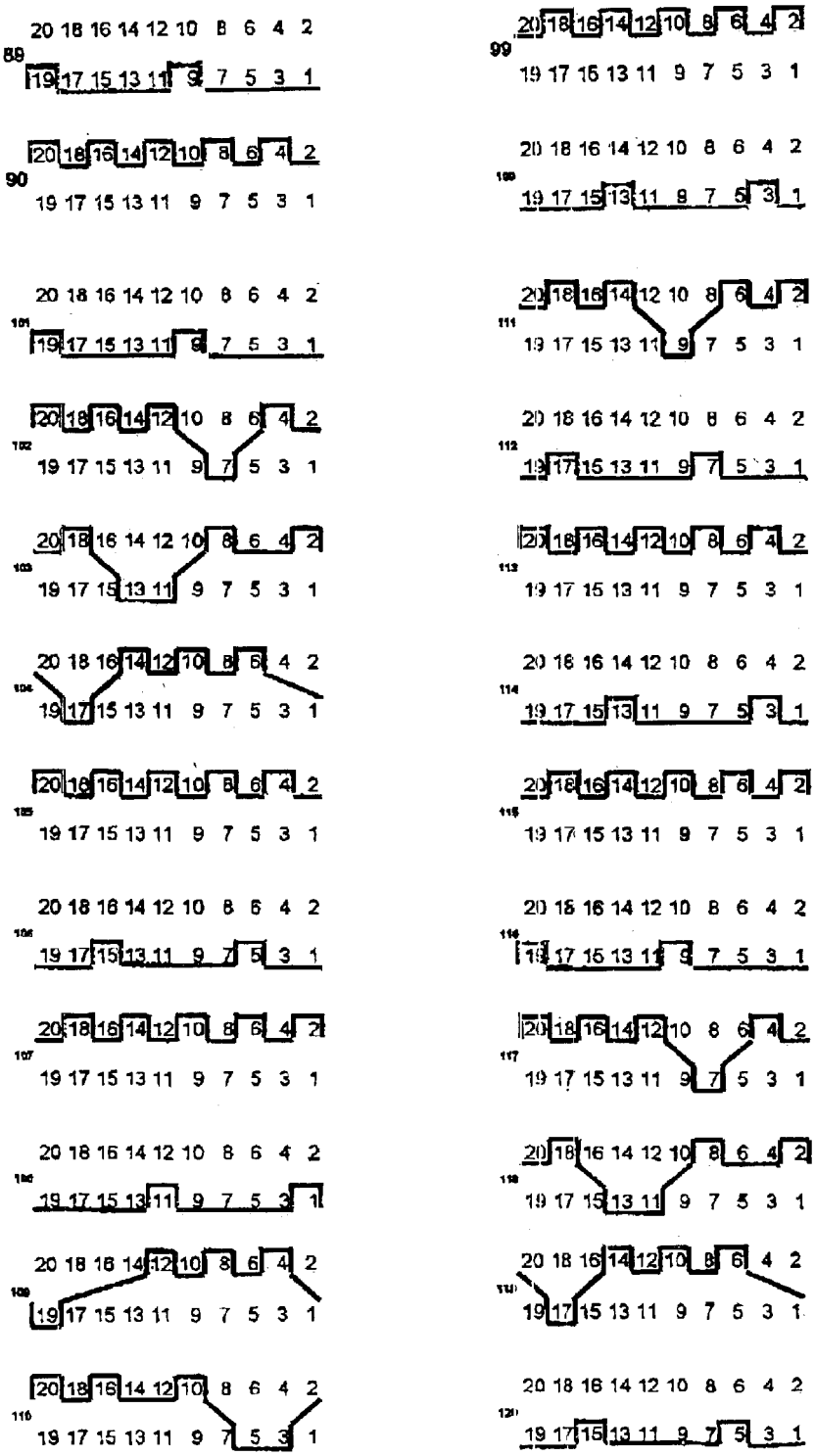
Figure 3:
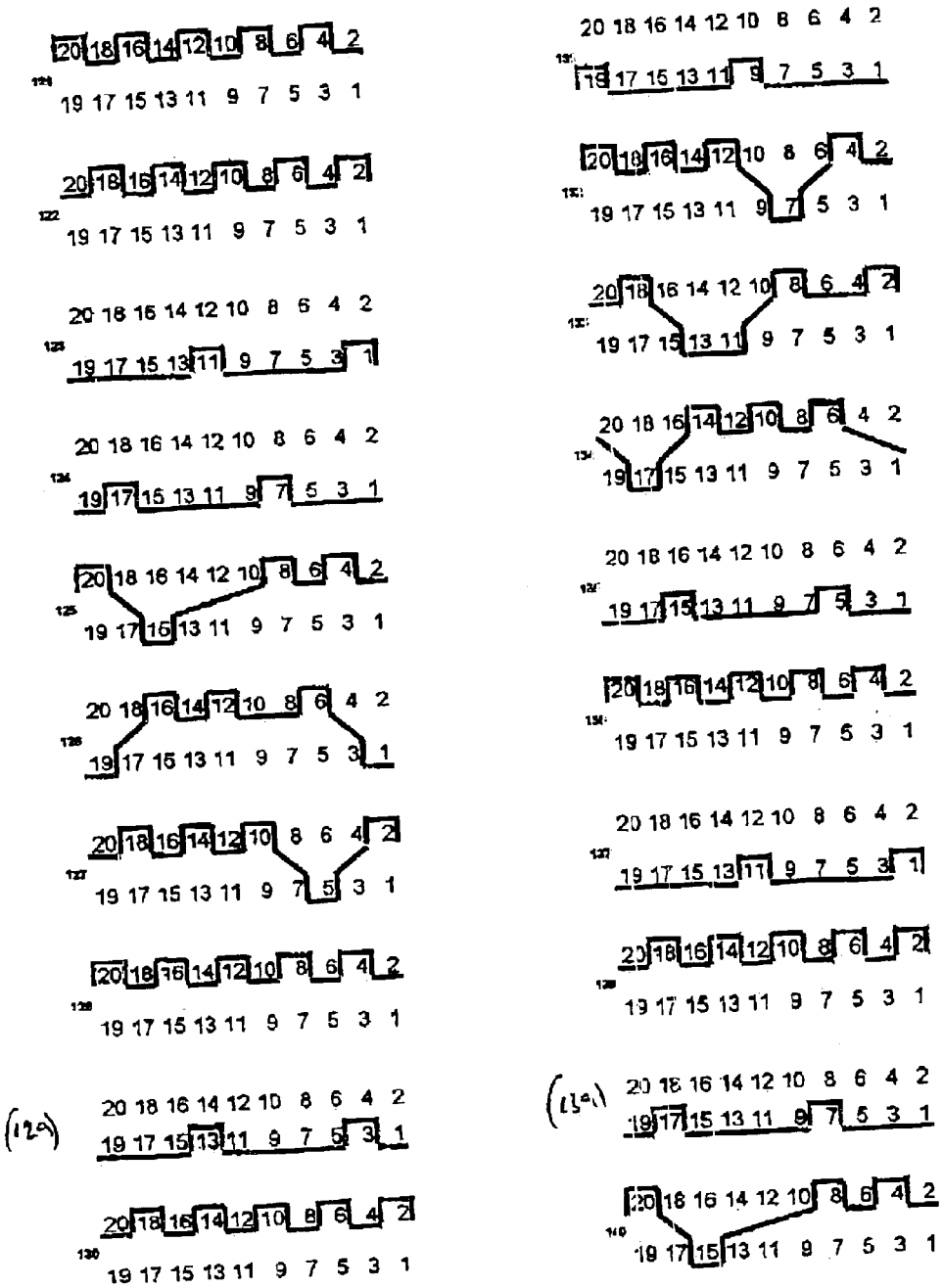
Figure 3:
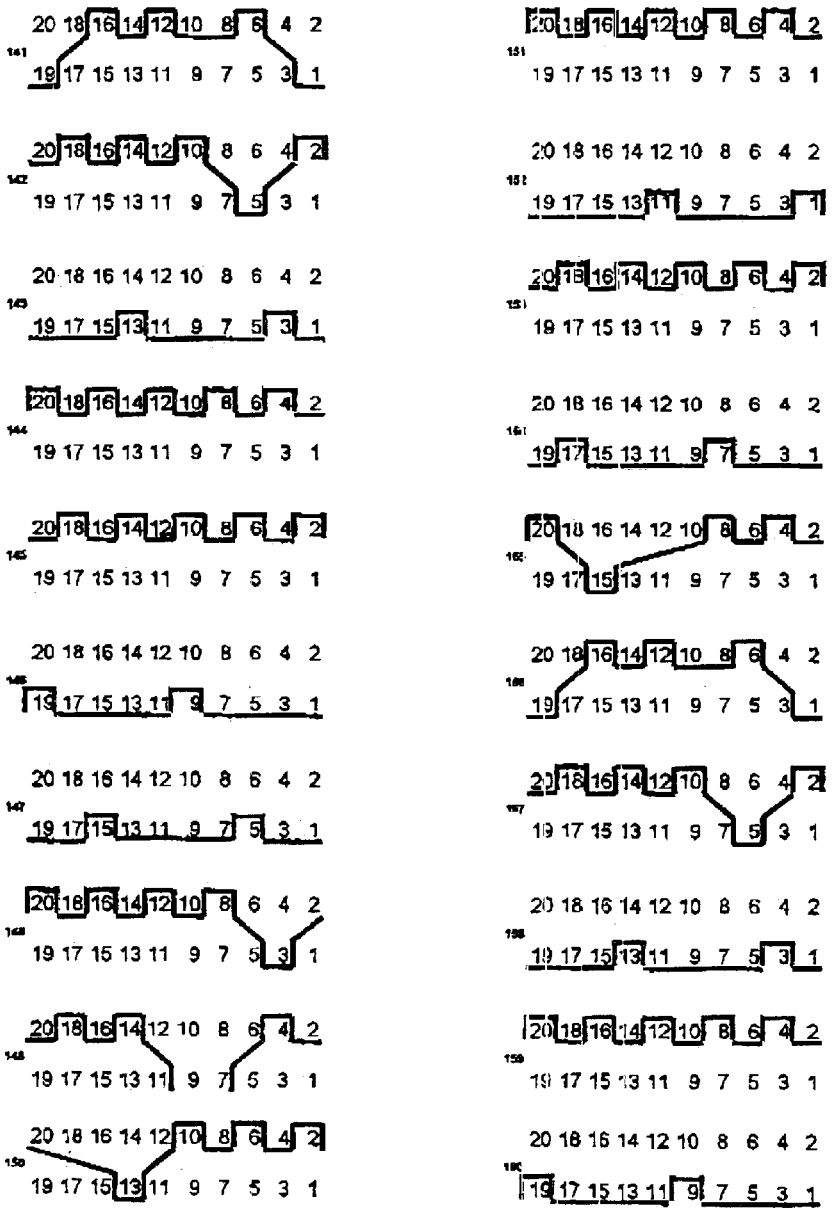
Figure 3:
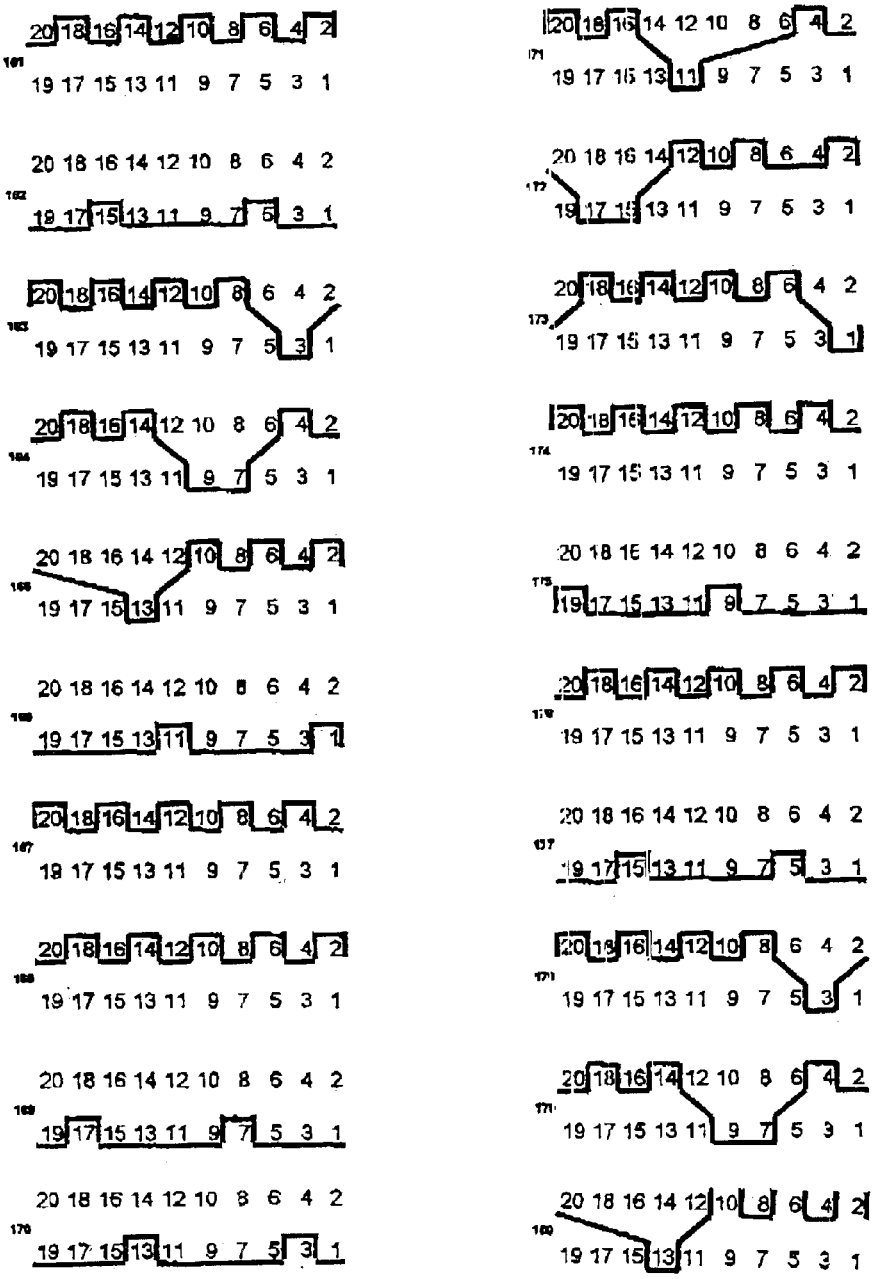
Figure 3:
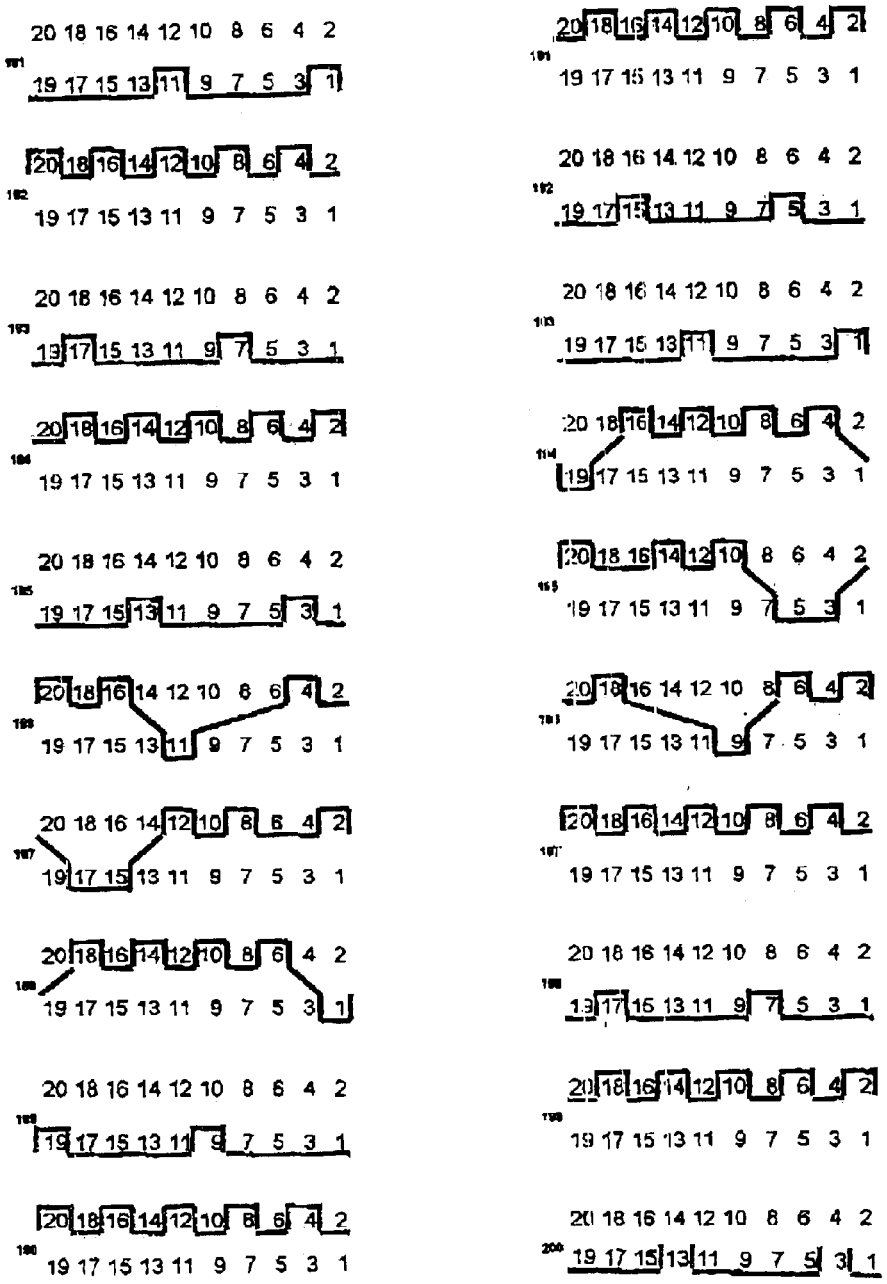
Figure 3:
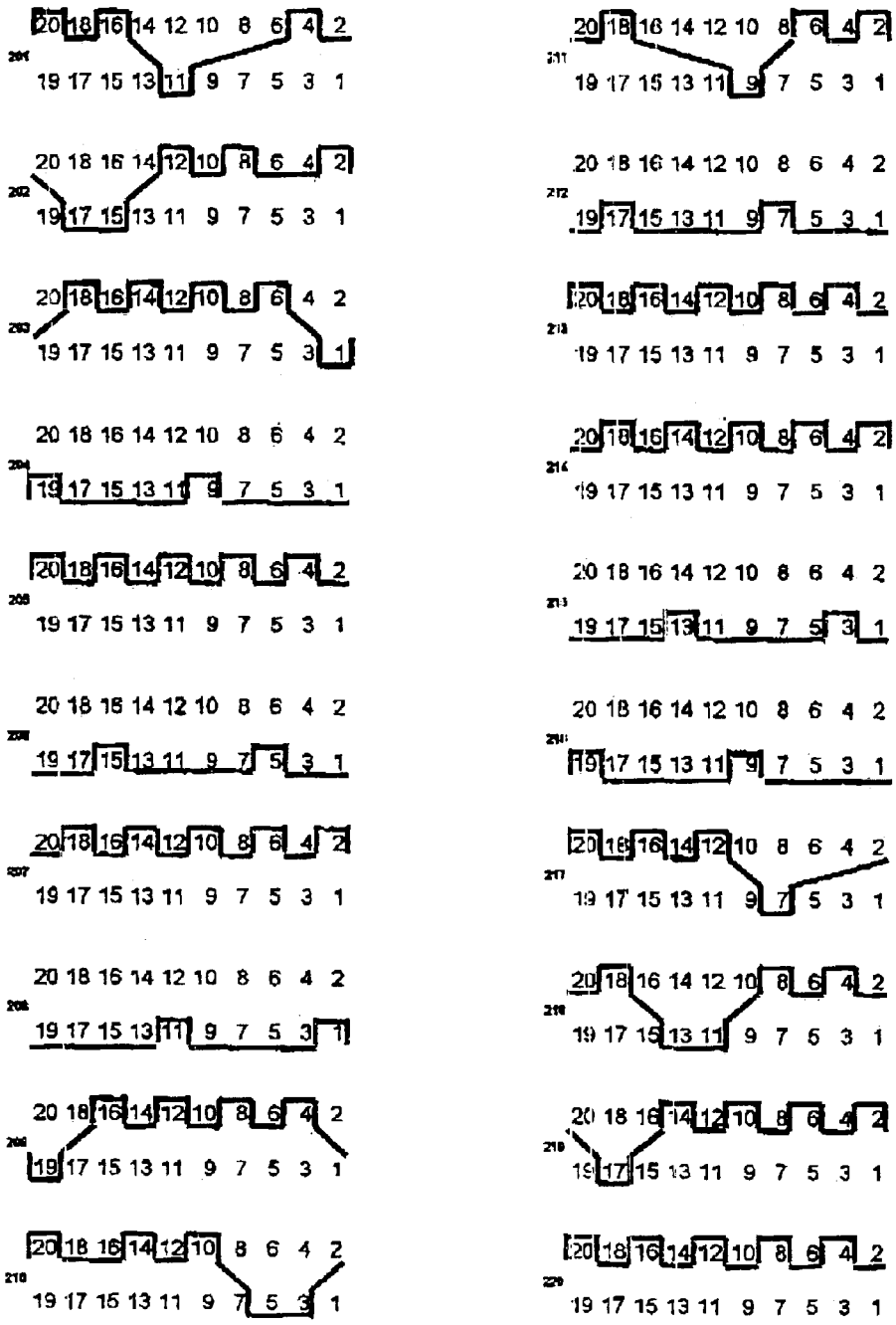
Figure 3:
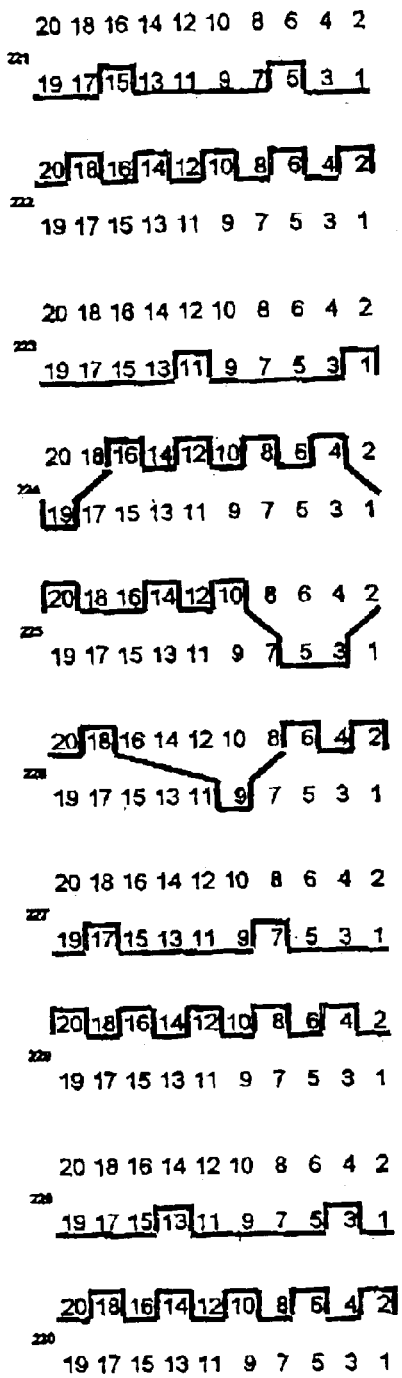

Referring to FIG. 3 a further triple layer fabric in accordance with the invention has a twenty yarn warp repeat and a 230 weft repeat. There is a 1:1 effective paperside to wearside warp ratio, comprising machine side warps (1, 3, 5, 7, 9, 11, 13, 15, 17, 19) and paperside warps (2, 4, 6, 8, 10, 12, 14, 16, 18, 20).

The weft yarns fall into three categories. The first set of weft yarns, as exemplified by wefts 1, 5, 8 and 9, bind only with the machine side warps, the weave repeat being over five machine side or wearside yarns, forming a knuckle over every fifth wearside yarn. Thus the fabric has a so-called five shaft back.

The second set of wefts, as exemplified by wefts 6, 7, 13 and 15 binds only with the paperside warps in a plain weave. These paperside wefts contribute to the fabric having a 3:2 effective paperside to wearside weft ratio.

The third set of wefts form triplet groups binding with both the paperside and machine side warps. Each triplet group forms two complete weft paths in the paperside surface. Each triplet repeats over twenty warps.

Furthermore, in this example, the individual triplets of each triplet group make three, three and four bindings respectively. As in the last example, the order of the outer binding wefts of the consecutive triplets can be reversed so as to remove visually apparent twill lines which manifest themselves in the paper formed in the fabric. Thus, triplets 2, 3 and 4 make three, three and four paperside knuckles respectively and triplets 10, 11, 12 make four, three and three paperside knuckles respectively.

The central triplets bind around two adjacent wearside warps, whereas the outer triplets only bind around individual wearside warps in each repeat.

The ratio of top paperside wefts to the triplet groups is 2:1; i.e. 60 paperside weft to 90 triplets. There are 60 triplet weft paths to 60 paperside weft paths (1:1).

It is to be understood that the above described embodiment is by way of illustration only. Many modifications and variations are possible.

Various "effective" paperside to wearside weft ratios can be used 1:1, 2:1, 3:2 as shown but also others, for example, 4:3, 3:1 and so forth. The selected "effective" paperside to wearside weft ratio is a trade off between optimising the fabric paperside properties and optimising the fabric wearside properties.

In all the disclosed embodiments the external triplets have a single wearside knuckle each and the central member of each set of triplets has a two float wearside binding knuckle. This is not an essential feature of the invention. The wearside binding frequency may be the same for all three members of each set of triplets or at least one member of at least one set of triplets may have a different number of wearside interlacings from the other two members of that set of triplets and the odd triplet member may be an external or a central member.

Similarly both paperside and/or wearside frequency and type of interlacings may vary from at least one triplet set to another within the same fabric.

The material chosen for the triplet members may be the same or different for the respective functional (i.e. central or external) triplet members to allow optimising of properties such as paperside surface smoothness, or binding integrity of the fabric.

What is claimed is:

1. A forming fabric having a paperside warp layer and a machine side warp layer, the fabric comprising at least one set of machine side wefts and at least one set of weft triplets, the weft triplets together forming two continuous weft paths on the paperside, all of said weft triplets interweaving with at least some paperside warps and at least some machine side warps.

2. A forming fabric as claimed in claim 1, wherein the fabric has a 20 warp repeat or greater.

3. A forming fabric as claimed in claim 2, wherein the fabric has a 20 warp repeat.

4. A forming fabric as claimed in claim 2, wherein the fabric has a 24 warp repeat.

5. A forming fabric as claimed in claim 1, wherein the machine side wefts make a single interlacing with the machine side warps over a 5 shaft or 6 shaft repeat.

6. A forming fabric as claimed in claim 1, wherein the machine side warps make multiple non-adjacent interlacings with the machine side wells over an eight or ten shaft repeat.

7. A forming fabric as claimed in claim 1, wherein the fabric further comprises a further set of wefts which bind only with the paperside warps.

8. A forming fabric as claimed in claim 7, wherein the further set of wefts bind with the paperside warps in a plain weave.

* * * * *

UNITED STATES PATENT AND TRADEMARK OFFICE

CERTIFICATE OF CORRECTION

PATENT NO. : 6,926,043 B2
DATED : May 30, 2003
INVENTOR(S) : Quigley et al.

It is certified that error appears in the above-identified patent and that said Letters Patent is hereby corrected as shown below:

Title page,
Item [73], Assignee, should read -- Voith Fabrics GmbH & Co. KG, Pfullingen, Germany. --.

Signed and Sealed this

Twentieth Day of September, 2005

JON W. DUDAS
*Director of the United States Patent and Trademark Office*